United States Patent [19]

Ratliff et al.

[11] Patent Number: 4,502,691

[45] Date of Patent: Mar. 5, 1985

[54] DESTRUCTIBLE TOY AIRCRAFT GAME

[76] Inventors: Raymond W. Ratliff, 4501 Ratliff La., P.O. Box 395, Addison, Tex. 75001; Eugene E. Smith, 2033 Oates Dr., Dallas, Tex. 75228

[21] Appl. No.: 564,822

[22] Filed: Dec. 23, 1983

[51] Int. Cl.[3] ..... A63F 9/02

[52] U.S. Cl. ..... 273/349; 273/375; 273/380; 273/384

[58] Field of Search ..... 273/349, 355, 357, 385, 273/380, 405, 384, 375, 374, 376

[56] References Cited

U.S. PATENT DOCUMENTS

| | | | |
|---|---|---|---|
| 1,235,771 | 8/1917 | Dettra | 273/380 |
| 1,277,702 | 9/1918 | Des Combes | 273/380 |
| 3,621,166 | 11/1971 | Lindstrom | 273/375 X |
| 3,869,825 | 3/1975 | Heberlein | 273/384 X |
| 4,039,188 | 8/1977 | Goldfarb et al. | 273/355 |
| 4,077,629 | 3/1978 | Chestney | 273/349 |

FOREIGN PATENT DOCUMENTS

| | | | |
|---|---|---|---|
| 891369 | 9/1953 | Fed. Rep. of Germany | 273/380 |
| 463076 | 3/1937 | United Kingdom | 273/384 |
| 648636 | 1/1951 | United Kingdom | 273/380 |

*Primary Examiner*—Paul E. Shapiro

*Attorney, Agent, or Firm*—Shlesinger Arkwright Garvey & Fado

[57] ABSTRACT

A destructible toy aircraft game, comprising a body having generally the shape of an aircraft fuselage and including a pair of wings; a pair of wings removably mounted to said body and one of said wings mounted to each of said sides; a latch mechanism for removably mounting said wings to said body; a release system operatively associated with said latch mechanism cooperating with said latch mechanism for securing said wings to said body when in a first latch position and for releasing said wings from said body when in a second release position; a motor assembly for disposing said release system in said release position from said latch position; a fluid pressure contact switch assembly cooperatively engaged with said motor assembly for activating said motor assembly for disposing said release system from said latch to said release position whereby said wings being released from said body thereby; and, a fluid pressure delivery system for directing pressurized fluid to said fluid pressure contact switch assembly is disclosed.

18 Claims, 7 Drawing Figures

DESTRUCTIBLE TOY AIRCRAFT GAME

BACKGROUND OF THE INVENTION

The present invention relates to useful improvements in action skill games and has for its purpose the improvement of the eye-hand coordination of the game players. Action games developing and improving the eye-hand coordination of the players are well known in the art and take many and varied forms. The present invention facilitates the development of the eye-hand coordination of the game players while permitting the players to freely roam about over an unbounded area.

Goldfarb, et al, U.S. Pat. No. 4,039,188, discloses and claims a toy aircraft action skill game in which a playing board has collapsible aircraft disposed at both ends. Each of the aircraft include means for propelling a projectile in the direction of the other aircraft with the intent to strike the target. The targeted aircraft, after having been struck repeatedly, assumes a simulated crash position, thereby designating the winner. The Goldfarb game is, however, limited to the area of the playing surface and requires that hard projectiles be launched by the aircraft.

Weise, German Pat. No. 891,369, discloses a toy aircraft game in which means are provided for the aircraft to assume a broken or struck position. Weise, however, fails to disclose means for improving the eye-hand coordination of the game player and does not disclose the actuating means of the present invention.

Consequently, a novel and unique game for improving the eye-hand coordination of the players while permitting the players to play over an unbounded area is desirable. The impact means for actuating the destruction mechanism of the game should, in the interest of safety, be of a type which will not cause injury to the players. Additionally, it is preferable that the impact means be of the type whereby parts cannot be lost and thereby render the game inoperable.

OBJECTS AND SUMMARY OF THE INVENTION

The present invention is a destructible toy aircraft game which includes a plurality of like aircraft, each of which comprises a fuselage to which a pair of wings is removably attached, and a cockpit which is designed to eject the pilot seated therein. A fluid power source is stored in the fuselage, and firing means are provided for directing a stream of pressurized fluid in the direction of another aircraft.

A primary object of the disclosed invention is to provide a destructible toy aircraft game overcoming the disadvantages of the prior art while simultaneously improving the eye-hand coordination of the game players.

Yet another object of the disclosed invention is to provide a destructible toy aircraft game permitting two players to be unconfined by a gameboard or defined area.

Still another object of the disclosed invention is to provide a destructible toy aircraft game having means for instantaneously indicating the winner of the game.

Still yet another object of the disclosed invention is to provide a destructible toy aircraft game employing pressurized fluid as the initiating means for causing the struck aircraft to be destroyed.

Still yet another object of the disclosed invention is to provide a destructible toy aircraft game which is relatively simple and inexpensive to manufacture.

Yet another object of the disclosed invention is to provide a destructible toy aircraft game in which the winner of the game is immediately recognized by the planned simulated destruction of his opponent's aircraft.

Yet still another object of the disclosed invention is to provide means operable by the pressurized fluid for causing the simulated aircraft breakage.

Yet a further object of the disclosed invention is to provide front and rear target areas to thereby permit more than two persons to play the game simultaneously.

Still yet a further object of the disclosed invention is to provide replaceable electric power supply means which are of sufficiently low power output to thereby avoid safety hazards.

A further object of the disclosed invention is to provide a destructible aircraft which may be readily reassembled to therefore continue play of the game.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
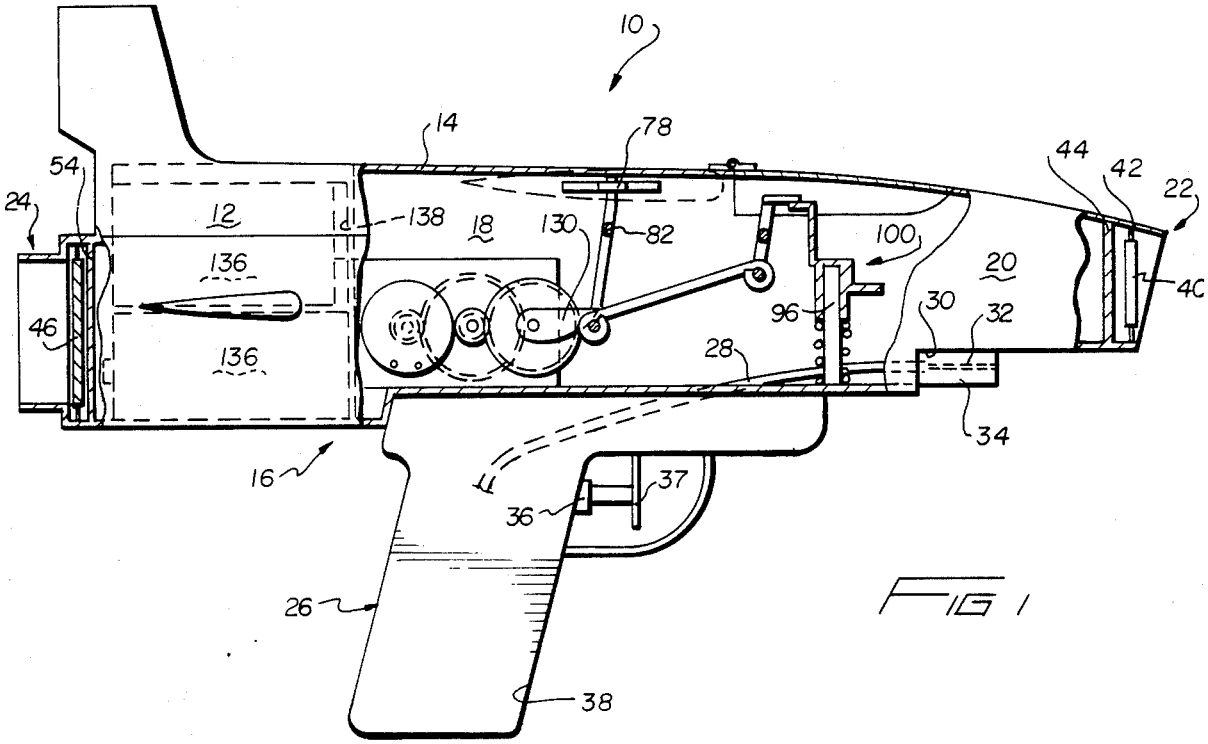
FIG. 1 is a side elevational view with portions shown in phantom and in section and with portions broken away of one of the aircraft of the game.
Figure 6:
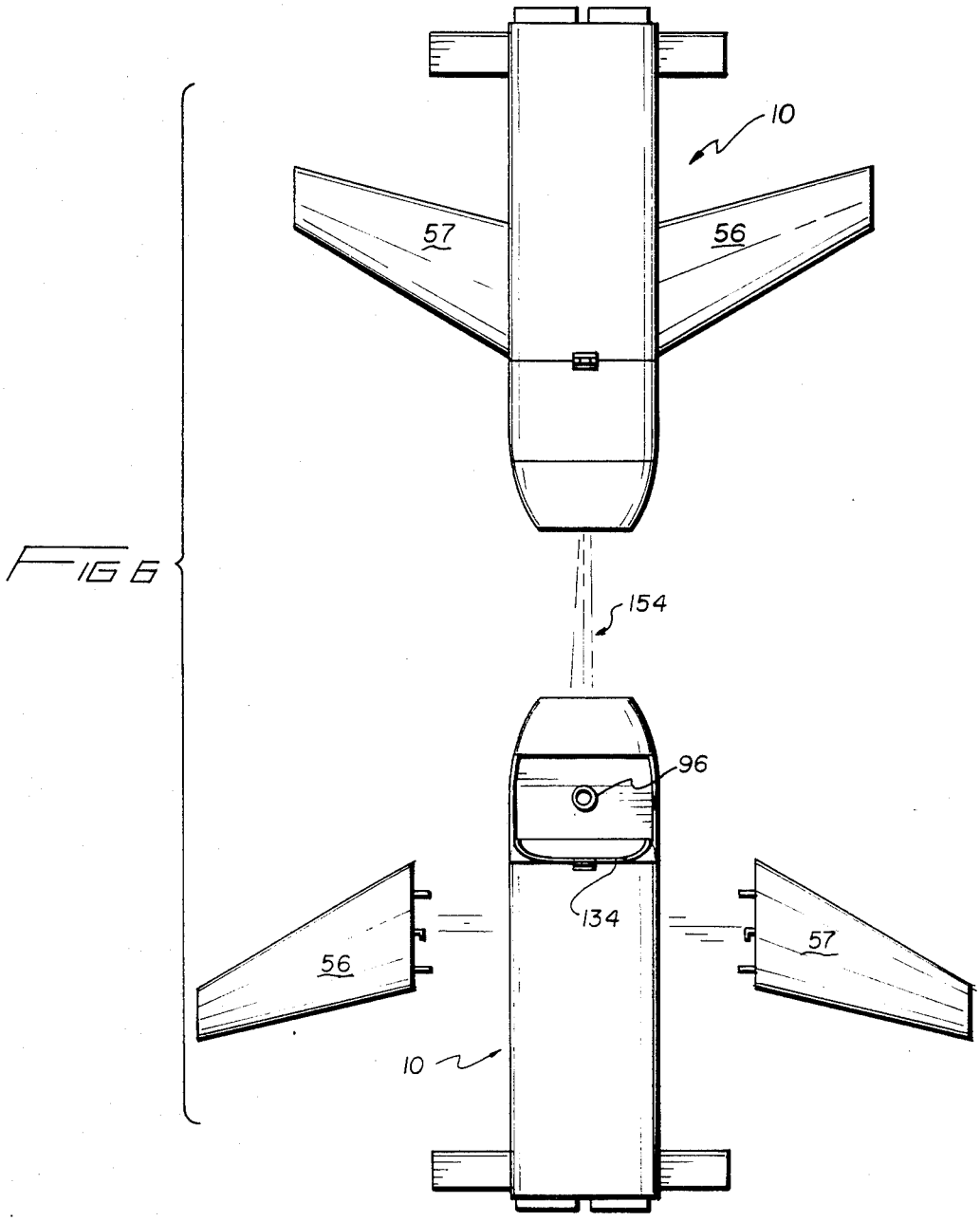
FIG. 6 is a top plan view of two of the aircraft of the game with the game being played and with one of the aircraft in the breakage position; and, FIG. 7 is a block diagram of the circuit for operating the aircraft breakage means.

A toy aircraft 10, as best shown in FIGS. 1 and 6, has a fuselage or body 12 including a top portion 14, a bottom portion 16 and opposed sides 18 and 20 disposed between top portion 14 and bottom portion 16. Body 12 has an open front 22 and an open rear 24, for reasons to be explained later.

Gripping and pressurized fluid propulsion storage means 26 are mounted on bottom portion 16 and include a fluid duct 28 extending upwardly from pressurized fluid propulsion means 26 through bottom portion 16. Fluid duct 28 extends outwardly beyond recess 30 of lower portion 16 and terminates in a fluid directing nozzle 32 within block 34. Pressurized fluid propulsion means 26 includes a manual player operated fluid pressurization means 36 actuated by a trigger 37, which is operatively associated with duct 28 and fluid reservoir 38 of pressurized fluid propulsion means 26 in a manner similar to that used in conventional water pistols. Reservoir 38 includes means (not shown) for refilling the reservoir as needed.

Figure 5:
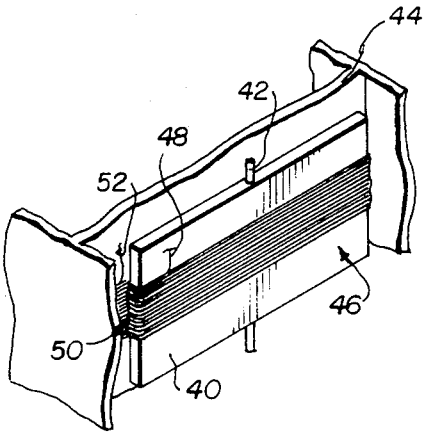
FIG. 5 is a fragmentary perspective view of one of the target areas of the aircraft.

As best shown in FIGS. 1 and 5, fluid pressure responsive contact switch plate 40 is rotatably mounted on a shaft 42 extending between upper portion 14 and lower portion 16. Fluid pressure contact plate 40 is free to pivot or rotate on shaft 42 when struck by pressurized fluid, preferably water, dispensed from pressurized fluid propulsion means 26 of one of the toy aircraft. Preferably, wall member 44 is disposed rearwardly of open front 22 and fluid pressure contact plate 40 in order to prevent the entry of fluid into the interior of body 12.

A plurality of loops 46 of conductive material, preferably copper wire, are wrapped around contact plate 40 and a lead 48 extends from loops 46, for reasons to be explained later. Similarly, a plurality of strands 50 of conductive material, preferably copper wire, are disposed on wall member 44 adjacent and aligned with loops 46 of contact plate 40. Lead 52 extends from strands 50 in a manner well known in the art, for reasons to be explained herein later.

While one contact plate assembly 40 is shown disposed in front portion 22, it should be noted that a similar contact plate assembly 40 is disposed in rear portion 24 for similar reasons and purposes. Similarly, a wall member 54 closes rear portion 24 and in this way the entry of pressurized fluid to the interior of body 12 is inhibited.

Figure 2:
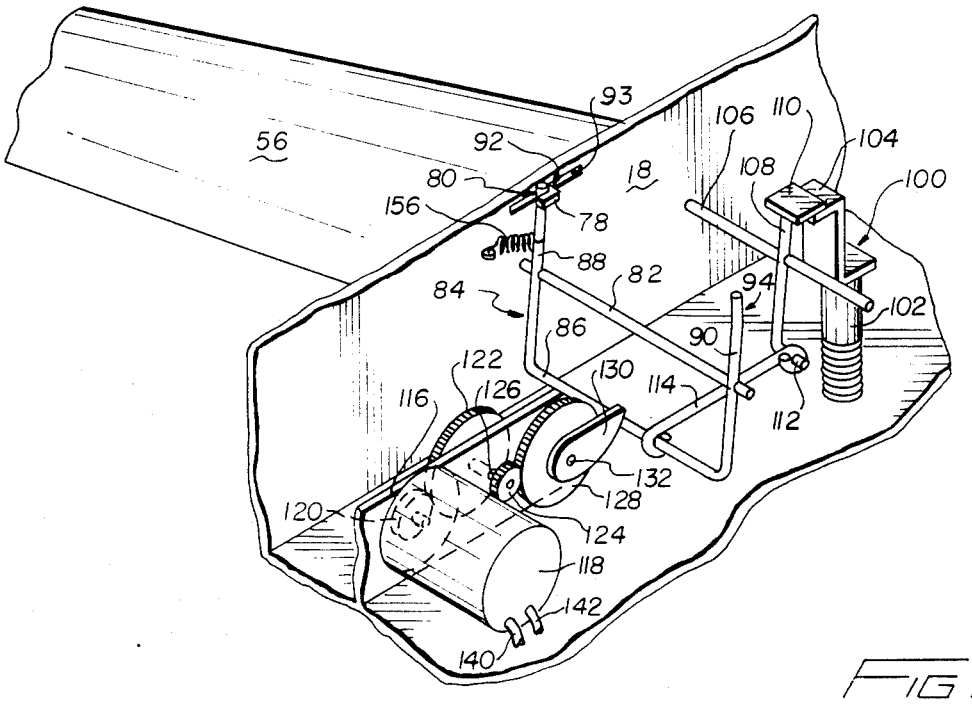
FIG. 2 is a fragmentary perspective view of the aircraft wing securing means as well as the aircraft breakage means.

As best shown in FIG. 2, a wing 56 is secured to side 18 of body 12. It should be obvious that a similar but oppositely oriented wing 57 is secured to side 20 and is best shown in FIG. 6. Because of the similarity of design, only the wing 56 will be described. Wing 56 includes a cavity 58 disposed adjacent side contacting portion 60 of wing 56. Openings 62 and 64 extend from cavity 58 through side contacting portion 60. U-shaped latch bar 66 is disposed in cavity 58 and includes arms 68 and 70, respectively, adapted for extending through openings 62 and 64. Recesses 72 and 74 are disposed in communication with cavity 58 and springs 76 are disposed in each of recesses 72 and 74 and press against latch bar 66 and, therefore, tend to urge arms 68 and 70 outwardly beyond side contacting portion 60. An L-shaped arm 78 extends outwardly from side contacting portion 60, approximately midway between opening 62 and 64, and defines a longitudinally extending rearwardly opening slot 80 with side contacting portion 60, for reasons to be explained herein later.

As best shown in FIG. 2, a shaft 82 is rotatably mounted to sidewall 18 and the other end of shaft 82 is similarly rotatably mounted to sidewall 20. Release means 84 is pivotally mounted to shaft 82. Release means 84 include a generally U-shaped member 86 having upstanding arm portions 88 and 90 disposed closely adjacent each of sidewalls 18 and 20, respectively. Each of arm portions 88 and 90 includes an angularly disposed portion 92 and 94, respectively, so that the angular portions 92 and 94 are generally vertically disposed when the release means 84 is disposed in the latch position, as best shown in FIG. 2. It should be noted in FIG. 2 that the angular portion 92 of arm portion 88 is disposed within slot 80 of L-shaped arm 78 extending through slot 93 of wall 18 and thereby serves to secure the wing 56 to the sidewall 18 with the effect that arms 68 and 70 are disposed in contact with sidewall 18 and the springs 76 are thereby under compression and, but for the engagement of arm portion 88 with L-shaped arm 78, the arms 68 and 70 would tend to cause the wing 56 to spring away from sidewall 18. It should be obvious, that similar wing 57 would be removably secured to sidewall 20 by means of engagement of its L-shaped arm 78 extending around a similar slot 93, with angular portion 94 of arm portion 90.

Figure 3:
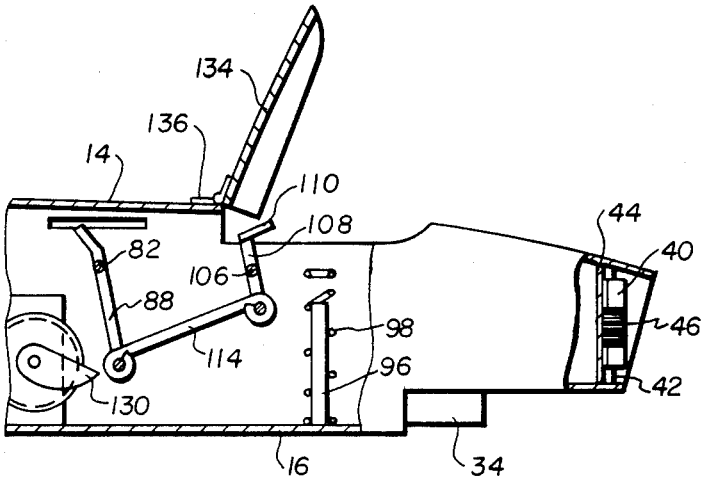
FIG. 3 is a fragmentary side elevational view with portions broken away and in section disclosing the aircraft securing means in the released position.
Figure 4:
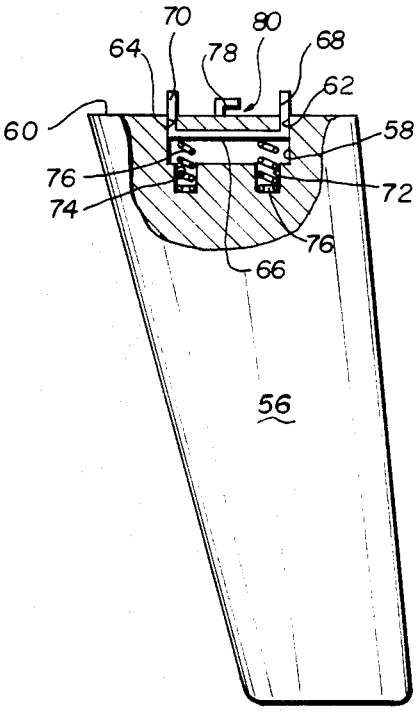
FIG. 4 is a top plan view with portions broken away of a wing of an aircraft.

As best shown in FIG. 3, a post 96 extends upwardly from bottom portion 16 and an annular spring member 98 is disposed thereabout. As best shown in FIG. 2, seat member 100 includes a cylindrical portion 102 extending downwardly therefrom and slidably disposed over post 96, thereby compressing spring 98. Seat 100 includes a support 104 depending therefrom generally horizontally to bottom portion 16.

Shaft 106 is rotatably mounted to sidewall 18, as best shown in FIG. 2, and the other end of shaft 106 is similarly mounted to sidewall 20. Seat release means 108 is pivotally mounted to shaft 106 and includes an arm 110 disposed at one end thereof and engagable with support 104 for thereby maintaining seat member 100 about post 96. Seat release means 108 includes an L-shaped arm 112 at the end opposite arm 110 which is connected by link 114 to seat release means 84. When release means 84 is disposed from its latch position, as best shown in FIG. 1, to its release position, as best shown in FIG. 3, seat release means 108 causes seat means 100 to be released from engagement with arm 110 with the effect that spring 98 propels seat member 100 upwardly, as best shown in FIG. 3.

As best shown in FIG. 2, wall member 116 is disposed between sidewalls 18 and 20 and electrically operable motor means 118 is secured thereto. Motor 118 includes a rotatable gear member 120 which is rotatably connected to gear 122 which is disposed on one side of wall 116. Gear 124 is coaxially secured to gear 122 on the opposite side of wall 116 by means of shaft 126. Gear 128 is rotatably connected to gear 124 and pawl 130 is coaxially mounted by shaft 132 to gear 128. The gears 120, 122, 124 and 128 represent, therefore, a speed reduction or gear train system for reducing the rotational speed of gear 120 of motor 118 while permitting pawl 130 to be rotated by operation of motor 118.

It should be noted in FIG. 1 that pawl 130 is of sufficient length such that it extends beyond member 86 of release means 84 so that rotation of gear 120 causes pawl 130 to strike member 86, causing release means 84 to therefore pivot on shaft 82. It can be seen in FIG. 3 that rotation of pawl 130 causes release means 84 to be disposed from its latch position of FIG. 2 to the release position of FIG. 3. The arms 88 and 90 are angularly rearwardly pivoted on shaft 82 and, similarly, seat release means 108 is pivoted on shaft 106 causing arm 110 to disengage from support 104 to thereby cause the release of seat member 100.

It should be noted in FIG. 3 that cockpit hatch cover 134 is connected by hinge 136 to top portion 14. The release of seat member 100 from post 96 causes the seat member 100, and preferably the pilot who would be positioned thereon, to angularly pivot hatch 134 because of the contact, and permit the seat 100 to be shot upwardly from body 12 beyond top portion 114.

As best shown in phantom lines in FIG. 1, batteries 136, each having a positive and a negative pole, are disposed in battery compartment 138. Preferably, the negative pole of each of batteries 136 is in electrical communication with motor 118 by means of cable 140. Similarly, the positive pole of each of batteries 136 is connected by lead 48 to loops 46 of contact plate 40. Lead 52 of strands 50 is in electrical communication with cable 142 of motor 118 and, consequently, rotation of contact plate 40 causes a continuous electrical circuit from batteries 136 through contact plate 40 to motor 18 which thereby causes the rotation of pawl 130 and the operation of release means 84 and 108. It will be noted in FIG. 3 that contact plate 40 has been pivoted on shaft 42 and that the loops 46 are pressing against wall member 44 with the result that the release means 84 has been activated.

Figure 7:
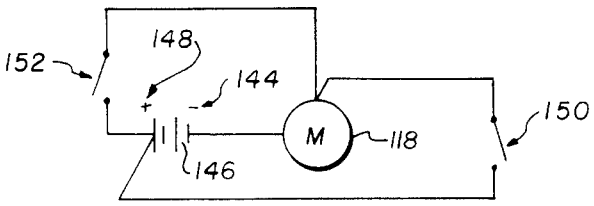

As best shown in FIG. 7, negative pole 144 of power source 146, which preferably includes dry cell batteries of a type well known in the art, is in electrical communication with motor 118. Positive pole 148 of power switch 146 is in electrical communication with contact switch plate assemblies 150 and 152 which are preferably similar to the contact plate assemblies 40 disposed at the front portion 22 and the rear portion 24 of aircraft 10. Switch assemblies 150 and 152 are in electrical communication with motor 118 and, consequently, the closing of either one of switch assemblies 150 and 152 causes the motor 118 to be energized. As has been previously explained, actuation of motor 118 causes the pawl 130 to rotate, with the result that the wings 56 are released from the aircraft 10 and the seat member 100 is propelled outwardly from body 10 beyond top portion 14.

OPERATION

The operation of the toy destructible aircraft game requires that at least two of the aircraft 10 be provided in order that the game be operable. The pressurized fluid propulsion system 26 of each of the aircraft 10, as best shown in FIG. 6, is filled with the fluid, preferably water, and the fluid pressure operator is manually activated by the game player (not shown) with the effect that a stream of fluid 154 is propelled outwardly beyond nozzle 32 of block 34.

In order to develop the eye-hand coordination of each of the game players (not shown), it is the intent of the game that each of the players direct the pressurized fluid of his aircraft in the direction of the contact switchplate assemblies 40 of his opponent's aircraft. It should be obvious that while one player is directing the stream of fluid from his aircraft toward the contact switchplate assemblies 40 of his opponent, the opponent is simultaneously maneuvering his aircraft 10 so that his contact switchplate assemblies 40 will not be hit while also moving his aircraft 10 into position to direct a stream of fluid toward the others. Eventually, the pressurized fluid stream of one aircraft strikes one of the contact switchplate assemblies 40 of his opponent's with the result, as best shown in FIG. 6, that the wings 56 spring free from the body 12 and the hatch 134 is opened by ejection of the seat member 100.

It should be appreciated that because no playing board is required, the game players may play the game over an unbounded area. Similarly, because the pressurized fluid propulsion means 26 is of relatively low pressure, there is little or no possibility that the pressurized fluid will cause injury. Similarly, the springs 76 and 98 are of relatively slight force and, consequently, the wings 56, as well as seat 100, do not have a great amount of propulsive force and thereby safety of the players is assured because any contact therewith will be of negligible impact.

After one of the aircraft 10 has destructed, reassembly to continue game play is simple and quick. The wings 56 and 57, with L-shaped arm 78, are secured to release means 84. Seat member 100 is disposed over post 96 and arm 110 engages support 104. Cockpit hatch 134 then rests against top portion 14 and game play may continue.

Preferably, a spring 156 is connected to arm 88 and sidewall 18 to facilitate the operation of release means 84. Spring 156 permits the rapid movement of the release means 84 from the latch position to the release position with the effect that the slightest contact of a stream of pressurized fluid with contact point 40 will result in release of the wings 56 and the seat 100.

While this invention has been described as having a preferred design, it is understood that it is capable of further modifications, uses and/or adaptations of the invention following in general the principles of the invention and including such departures from the present disclosure as come within known or customary practice in the art to which the invention pertains, as may apply to the central features herein before set forth and fall within the scope of the invention to the limits of the appended claims.

What we claim is:

1. A destructible toy aircraft game, comprising:

(a) a body having generally the shape of an aircraft fuselage and including a pair of sides;

(b) a pair of wings removably mounted to said body, one of said wings mounted to each of said sides;

(c) latch means associated with each of said wings for removably mounting said wings;

(d) release means operatively associated with said latch means cooperating with said latch means for securing said wings to said body when in a first latch position and for releasing said wings from said body when in a second release position;

(e) motive means disposing said release means in said release position from said latch position; and, (f) fluid pressure responsive means cooperatively engaged with said motive means for activating said motive means upon application of pressurized fluid for disposing said release means from said latch position to said release position whereby said wings being released from said body thereby.

2. The game as defined in claim 1, further comprising:

(a) spring means cooperating with said latch means for propelling said wings from said body when said wings are released.

3. The game as defined in claim 2, wherein:

(a) each of said wings including a cavity with at least one opening communicating with its associated side;

(b) latch bar means disposed within said cavity and including at least an arm extending from said opening when said wings are released;

(c) said spring means disposed within said cavity and bearing against said latch bar means for propelling said wings from said body when said wings are released; and, (d) said latch bar means compressing said spring means when said wings are secured to said body and said release means are in said latch position whereby said at least an arm being disposed within said opening.

4. The game as defined in claim 1, wherein:

(a) said latch means including an L-shaped arm extending from each of said wings into said body when said wings are mounted to said body;
(b) said release means including an arm for each of said wings engaging said L-shaped arm of each of said wings when in said latch position; and,
(c) said release means arms being moved out of engagement with said L-shaped arm when in said release position for releasing said wings thereby.

5. The game as defined in claim 4, wherein:
(a) said release means arms being interconnected and having generally a U-shaped configuration; and,
(b) spring means secured to one of said arms of said U and to an associated side for permitting rapid disengagement of said release means arms from said latch means.

6. The game as defined in claim 5, wherein:
(a) said motive means including a motor; and,
(b) a pawl operatively associated with said motor and adapted for striking said U-shaped release means for disposing thereby said release arms out of engagement with said latch means.

7. The game as defined in claim 6, wherein:
(a) a gear train operatively associated with said motor and rotatable therewith; and,
(b) said pawl mounted to said gear train.

8. The gear as defined in claim 6, wherein:
(a) said fluid pressure responsive means including a contact plate rotatably mounted to said body;
(b) a support mounted to said body adjacent to and adapted for being contacted by said contact plate for providing a switch assembly therewith;
(c) electric power means having a positive and a negative pole disposed in said body;
(d) one of said poles connected to said motive means and to one of said support and contact plates; and,
(e) the other of said poles connected to said motor and to the other one of said support and contact plates for operating said motor upon contact of said support and said plate for thereby rotating said pawl.

9. The game as defined in claim 8, wherein:
(a) said body including a front portion and a rear portion; and,
(b) a switch assembly mounted to said front portion.

10. The game as defined in claim 9, further comprising:
(a) said body including a top;
(b) a hatch hingedly connected to said top;
(c) seat means removably mounted in said body adjacent said hatch means; and,
(d) seat release means operatively associated with said release means for securing said seat means in said latch position and for releasing said seat means when in said release position.

11. The game as defined in claim 10, wherein:
(a) spring means cooperating with said seat means propelling said seat means from said body beyond said hatch when said seat is released.

12. The game as defined in claim 11, wherein;
(a) a post positioned in said body adjacent said hatch;
(b) said seat means slidably mounted to said post; and,
(c) said spring means being annularly mounted about said post.

13. The game as defined in claim 12, wherein:
(a) said seat means including a support; and,
(b) said seat release means including an arm extending from said U-shaped release means and including a portion engageable with said support when in said latch position and disengaged from said support when in said release position.

14. The game as defined in claim 1, further comprising:
(a) a fluid container mounted to said body; and,
(b) means associated with said container for supplying and directing a fluid under pressure toward said fluid pressure responsive means.

15. The game as defined in claim 14, wherein:
(a) said means for supplying fluid under pressure being manually operable; and,
(b) two of said bodies cooperate whereby an operator of one of said bodies directs pressurized fluid toward the fluid pressure responsive means of the other to thereby cause said release means to be disposed from said latch to said release position.

16. The game as defined in claim 4, wherein:
(a) said L-shaped arm defining a longitudinally extending rearwardly opening slot for receiving said release means.

17. The game as defined in claim 8, wherein:
(a) said support including a plurality of electrically conducting strand means;
(b) a post rotatably supporting said contact plate; and,
(c) a plurality of electrically conducting loop means secured to said contact plate whereby said loops adapted for contacting said support strands for permitting current flow for operating said motor thereby.

18. The game as defined in claim 8, wherein:
(a) said electric supply means including at least a first battery.

* * * * *